United States Patent [19]

Uhlmann

[11] 4,387,716

[45] Jun. 14, 1983

[54] APPARATUS FOR USE IN LIVESTOCK OBSTETRICS

[75] Inventor: Georg Uhlmann, Koblenz, Fed. Rep. of Germany

[73] Assignee: Rheintechnik, Weiland & Kaspar KG, Neunkirchen, Fed. Rep. of Germany

[21] Appl. No.: 254,623

[22] Filed: Apr. 16, 1981

[30] Foreign Application Priority Data

Apr. 15, 1980 [DE] Fed. Rep. of Germany ..... 3014301

[51] Int. Cl.[3] ..... A61D 1/08

[52] U.S. Cl. ..... 128/352; 128/353

[58] Field of Search ..... 128/352, 353, 356

[56] References Cited

U.S. PATENT DOCUMENTS 3,863,642 2/1974 Weiland ..... 128/353

3,870,049 3/1975 Weiland ..... 128/352

FOREIGN PATENT DOCUMENTS 2819050 10/1979 Fed. Rep. of Germany ..... 128/353

*Primary Examiner*—Richard J. Apley

*Assistant Examiner*—George Yanulis

*Attorney, Agent, or Firm*—Max Fogiel

[57] ABSTRACT

An apparatus is provided for livestock obstetrics. The apparatus bears against the body of the dam, a leg sling is placed on the offspring, and two slides can progressively be moved along a rod to tension the leg sling. To move the slides, a tensioning lever is hinged to one slide, and an intermediate lever is hinged at a different location to the one slide and is also hinged to the other slide. The intermediate lever is in two parts normally held together by spring tension, but if an excess load is applied by the tensioning lever the spring tension is overcome and the parts separate, whereby maximum permissible tension between dam and offspring is not exceeded. To completely release the pull on the offspring, the tensioning lever can be moved to release both slides.

8 Claims, 2 Drawing Figures

1
2
28a
3
4
5b
5a
28b
27
6
7
29
8
9
10
11
12
13
14
15
16
17
18
19
20
21
22
23
24
25
26
30
31
33

1
10
12
14
16
17
20
22
25
26
32
33

APPARATUS FOR USE IN LIVESTOCK OBSTETRICS

The invention relates to an apparatus for use in livestock obstetrics, consisting of a rod device adapted to bear against the body of the dam, with two slides arranged upon the rod and adapted to be slidably displaced and locked alternately. A leg sling for the offspring can be secured to the slides. To provide progressive tensioning of the leg sling, a tensioning lever is hinged to one slide, preferably the one facing away from the dam when the apparatus is in use, and an intermediate lever is hinged at one end to the tensioning lever, at a distance from one slide, and is hinged at its other end to the other slide. Means actuated by the tensioning lever are provided for unlocking the slides from the rod.

An example of a device of this general type is described in German Pat. No. 1,133,076. Such devices have proven to be outstandingly successful. The rod is generally in the form of a composite tube having a steel core enclosed in a threaded tube.

In order to ensure immediate release of the slides secured to the rod, in the event of danger or excessive stresses for the cow or the calf, so that the slides slip along the rod towards the dam and release the tension on the calf, it is proposed according to German Offenlegungschrift No. 22 32 713 to provide the slides with sloping incisions into which perforated discs are inserted. When the apparatus is under tension, the inner edges of the discs engage threads in the rod, from which they may be disengaged by the tensioning lever or the intermediate lever. This allows the slides to slip along the rod toward the dam, so that the tension on the calf is immediately released.

In order to avoid danger or excessive stress for the dam or the offspring due to excessive tension on the latter by the apparatus, it has been proposed, in German Offenlegungschrift No. 28 19 050, to design the tensioning lever as an overload lever which buckles under a specific load. However, a disadvantage of this kind of tensioning lever is that it is no longer possible to use the tensioning lever to release the slides locked to the rod.

It is an object of the invention to provide an apparatus of the type described in which the tensioning lever becomes ineffective at a predetermined maximum load and may then still be used to actuate the means for releasing the slides locked to the rod. This object can be achieved by providing a two-part intermediate lever whose parts can be pulled apart agains the force of resilient means adjustable to a desired load.

The resilient means can be adjusted to a load no greater than that which provides the maximal permissible tension between dam and offspring. If a force is applied to the tensioning lever which would lead to a greater tension, the parts of the intermediate lever pull apart, the tensioning lever becomes ineffective, and the slide nearest the dam cannot be pulled further away from her. Thus the tension between the dam and the calf cannot be increased. In spite of this, it is possible to actuate the means for releasing the slides from the rod by means of the tensioning lever or the intermediate lever, since neither of them buckles.

At the time of the birth of a calf, extreme cleanliness must be obtained at the site in order to prevent infection of the cow or calf. The rods of devices heretofore proposed are threaded tubes, or have peripheral grooves in their surfaces, engaging with the means for locking the slides to the rod. Cleaning the apparatus after each birth is therefore difficult, and unless this is done with the greatest of care, there is a danger of the next calf or cow becoming infected.

It is a further object of the present invention to provide a device of the type described, which is easy to clean, to eliminate the danger of infection of the calf or cow.

This object is, in part, achieved by slides in the form of sleeves having recesses which open toward the supporting rod, the recesses having surfaces inclined towards the rod in the direction of tension, with rollers adapted to be clamped in the recesses between the inclined surfaces and the rod.

If the tensioning lever is used to move one of the sleeves away from the dam, the other sleeve being locked, the roller which lies in the end of the recess facing the dam is carried along with the sleeve. As soon as the pull on this sleeve ceases, it slides back and the roller is clamped between the inclined surface and the rod, thus locking the sleeve. It is also possible to provide, a resilient buffer, between the wall of the recess facing the dam and the roller, so that the distance by which the sleeve slides back, before the roller is clamped, is scarcely measurable.

With this arrangement of rollers it is unnecessary to use a rod having threads or peripheral grooves. Instead, the rod may be completely smooth and is therefore easy to clean and to keep clean. A smooth rod also has the advantage, over a rod with peripheral grooves or threads, in that the veterinarian runs less risk of injuring his hands and becoming infected. In addition a smooth rod makes it possible to displace the sleeves in very small steps, thereby providing very fine metering of the tension between cow and calf. Furthermore, with no recesses in the rod, wear is small.

The sleeves can be provided with openings at their ends away from the dam and facing the tensioning lever, said openings running parallel with the tensioning lever. In these openings are tappets with one end bearing upon a roller and the other end projecting from the sleeve. The tensioning lever is provided with an extension on its side facing the bar, said extension, being adapted to force the tappet in one sleeve thereinto and against the roller, when the tensioning lever is fully depressed, thus releasing the one sleeve. The latter then presses against the tappet in the other sleeve and presses it against the roller, thereby releasing the other sleeve.

This arrangement has the advantage that even when force can no longer be applied by the tensioning lever to the sleeve nearest the dam, the sleeves are fully releasable by the tensioning lever and can slide along the rod towards the dam.

If the sleeves are not to be released, the sleeve nearest the dam can be moved further by the tensioning lever only when the resilient means have expanded and the force required is less than that needed to pull apart the two parts of the intermediate lever.

The apparatus is adjusted by the manufacturer and sealed. It cannot therefore be inadvertently adjusted.

Further features of the invention will become apparent from the following description of the drawings and claims.

One embodiment of the invention is illustrated by way of example in the accompanying drawing, but the invention is not restricted thereto. In the drawing.

Figure 1:
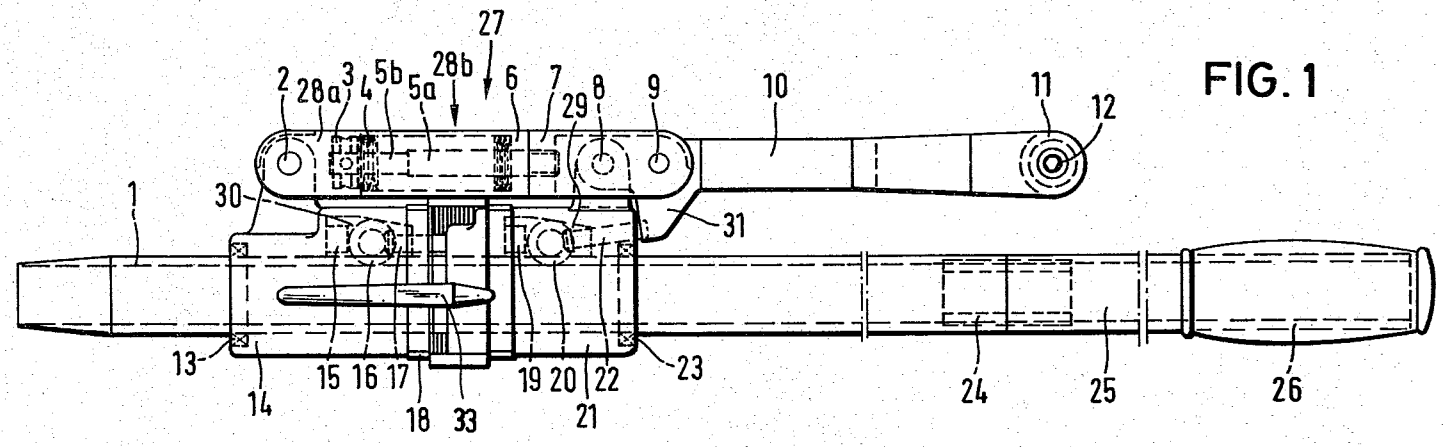
FIG. 1 is a side view of an apparatus according to the invention.
Figure 2:
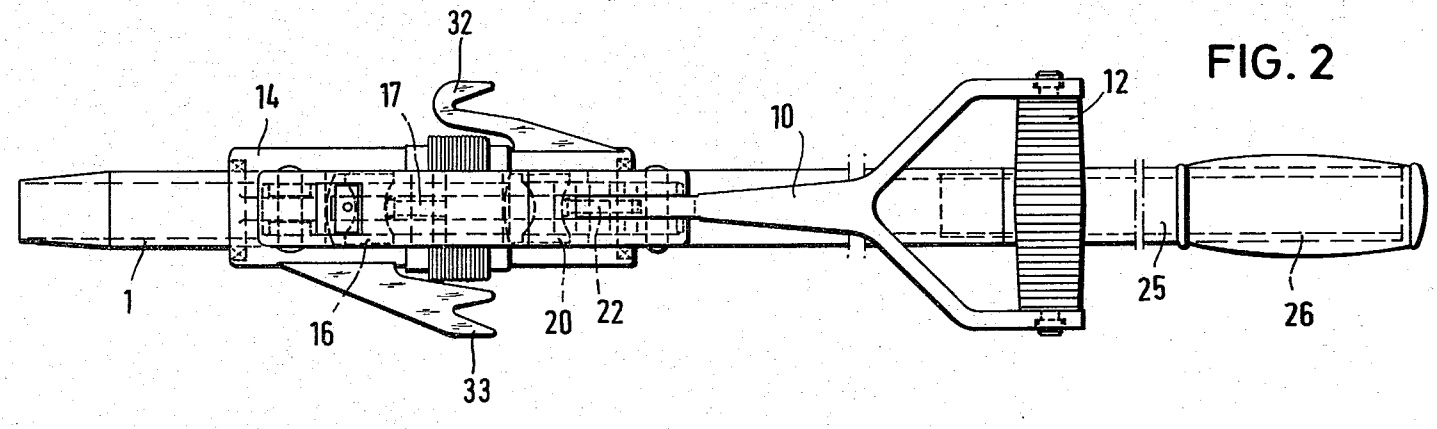
FIG. 2 is a plan view.

In the drawings, rod 1 is in the form of a hollow tube with a smooth exterior. The left-hand end of the rod faces the dam when the apparatus is in use, and carries a transverse bar (not shown since it forms no part of the invention). The end of rod 1 away from the dam preferably consists of telescoping parts 24, 25, with a handle 26 for the rod as a whole. Arranged between the end of rod 1 facing the dam and the telescoping parts are two sleeves 14, 21 adapted to slide along the rod and to be locked thereto. Tensioning lever 10 is hinged at 8 to one sleeve 21, namely the one remote from the dam. At its free end the lever 10 has a handle 11 secured to the lever by a bolt 12. At a short distance from hingepoint 8, namely at 9, one end of an intermediate lever 27 is hinged to the tensioning lever 10, the other end thereof being hinged, at 2, to the other sleeve 14. Sleeve 21 carries laterally a hook 32, and sleeve 14 carries hook 33. These hooks are open at the end facing away from the dam. Engaged in each of these hooks is one end of a leg-sling (now shown), the other end of which is slung around one leg of the calf. Intermediate lever 27 is made in two parts. It consists of a first part 7 hinged to tensioning lever 10 and second part 28 hinged to sleeve 14. At the end remote from tensioning lever 10, the first part 7 of the intermediate lever has a rodlike extension 5 carrying resilient plate-spring elements 4. At the free end of the extension 5 is a locking element 3, preferably a cap-screw. The second part 28 of the intermediate lever is hollow and encloses the stack of plate-springs 4. The end wall 6 of part 28, facing tensioning lever 10, has an opening for the rod-shaped extension 5 and serves as an abutment for the stack of plate-springs at the end remote from locking element 3. The part 28 may consist of two members 28*a*, 28*b* which screw together. After the extension 5 has been passed through the opening in plate 6, and the stack of plate-springs 4 has been installed, and the locking element 3 has been tightened, the members 28*a* and 28*b* are screwed together. It is also possible to make extension 5 in two parts 5*a* and 5*b* adapted to be screwed into each other, part 5*a*, nearer the tensioning lever 10, being preferably hollow and internally threaded, whereas part 5*b* is externally threaded and solid. The preload on the springs 4 can be adjusted by adjustment of the position of the locking element 3, or of part 5*b* of the extension. For this purpose, suitable means can be provided in or through member 28*a* to adjusting means of element 3 or part 5*b*, once an appropriate seal has been removed.

The sleeves 14 and 21 have inner recesses 29, 30 which open towards the rod 1. The surfaces of recesses 29 and 30, remote from the rod 1, are planes inclined towards the rod 1 in the direction away from the dam. Arranged in the recesses are rollers, e.g. balls 20, 16, the diameter of which is larger than the shortest distance between said inclined planes and the rod 1. If sleeves 14, 21 are under tension applied to hooks 32, 33, the balls 20, 16 are in the recesses 29, 30 in the direction away from the dam, so that the balls, lock the sleeves 14, 21 to the rod 1. If the free end of tensioning lever 10 is now moved away from the rod 1, the sleeve 14, facing the dam, remains stationary, while the sleeve 21, away from the dam, is pulled away from her. Ball 20 moves in recess 29 to the higher part of the said recess, thus releasing the lock between rod 1 and sleeve 21, which can now be moved away from the dam. If the tensioning lever 10 is moved in the opposite direction, the other sleeve 14 is moved accordingly, away from the dam.

The construction of intermediate lever 27 makes it possible to adjust it to a desired preload. In Denmark, the prescribed preload is 160 kg; in Germany the requirement corresponds to the strength of four persons, i.e. about 160 to 200 kg. If a greater force is applied to the tensioning lever 10, springs 4 will be compressed and sleeve 14 can no longer be pulled away from the dam by the tensioning lever 10; rather, the lever parts 7, 28 pull apart because the load on the springs has been overcome.

In the event of danger or excessive stress on the dam or offspring, immediate release of the locking action between sleeves 21, 14 and rod 1 may be necessary, to allow the sleeves to slide along the rod towards the dam and release the tension immediately. For this purpose, the recesses 29, 30 are arranged in the sleeves 21, 14 at the ends nearer the tensioning lever 10. At these ends the sleeves have openings, between recesses 29, 30 and the end walls, and tappets 22, 17 are mounted in these openings, one end of each tappet bearing against a ball while the other end projects from the sleeve. On its side facing the rod 1, the tensioning lever 10 has an extension 31. If the tensioning lever is forced as far as possible towards rod 1, extension 31 presses tappet 22 in sleeve 21 towards ball 20. This releases the ball and the sleeve 21, which slides towards the other sleeve 14. Here it strikes the free end of tappet 17 which releases ball 16 from its locked position. This releases second sleeve 14, so that both sleeves can slide towards the dam. The space between sleeves 14 and 21 is preferably covered with a sleeve 18 which overlaps the facing ends of sleeves 14 and 21. This prevents dirt from penetrating between the sleeves 14 and 21. At the oppositely facing ends, between sleeves 21, 14 and rod 1, are seals 23, 13, to prevent dirt from penetrating between rod 1 and parts 21, 14.

In order to ensure that after the sleeves have been moved away from the dam, the sleeves slip back as little as possible until balls 16, 20 have become clamped in recesses 29, 30 between rod 1 and the inclined planes, resilient buffers 19, 15 are provided in the ends of the recesses nearest the dam. These ensure that the distance travelled by sleeves 14 and 21 until they become locked cannot be measured in practice.

The embodiments of the invention in which an exclusive property or privilege is claimed are defined as follows:

1. An apparatus for use in livestock obstetrics, comprising: means adapted to bear against the body of the dam, and comprising a rod, two slides on the rod with means for alternately displacing and locking the slides along the rod, said slides having means for progressive tensioning of a sling for the offspring, a tensioning lever hinged to one slide, a two part intermediate lever having one part hinged to the tensioning lever at a location different than said one slide, the other part of the intermediate lever being hinged to the other slide, and resilient means actuated by said tensioning lever for allowing the parts of the intermediate lever to pull apart at a predetermined load, said tensioning lever being hinged to the slide that is remote from the dam when the apparatus is in use, and means actuatable by said tensioning lever for unlocking the slides from said rod, said tensioning lever becoming ineffective at said predetermined load and being thereupon able to actuate said resilient means, said resilient means being adjustable to a desired load and providing a force against which the two parts of said intermediate lever can be pulled apart.

2. An apparatus as claimed in claim 1, wherein the one part of the intermediate lever that is hinged to the tensioning lever has a rodlike extension, and the resilient means comprise plate-springs tensioned to said predetermined load and secured on the extension by locking means, the other part of the intermediate lever that is hinged to said other slide being hollow with an open end which receives said extension, said open end normally engaging said one part and having an abutment for said resilient means.

3. An apparatus as claimed in claim 1, wherein the slides comprise sleeves each having a recess opening towards the rod, each recess having a surface remote from the rod and inclined to the rod, and a roller in each recess adapted to be clamped between said surface and the rod to lock the sleeve on the rod.

4. An apparatus as claimed in claim 3, wherein a tappet extends from each recess and the tensioning lever can be moved to force the tappet in said one slide against the roller thereof to unclamp it and unlock the one slide from the rod and cause the one slide to press the tappet in said other slide against its roller to unclamp it and unlock the other slide from the rod.

5. An apparatus as claimed in claim 3 or 4, wherein a buffer is provided in each recess for the unclamped roller.

6. An apparatus as claimed in claim 1, 2 or 4, wherein the slides are sleeves that are overlapped by another sleeve to keep dirt from between them.

7. An apparatus as claimed in claim 3, wherein the rod is a smooth rod.

8. An apparatus as claimed in claim 1, wherein the one part of the intermediate lever that is hinged to the tensioning lever has a rodlike extension, and the resilient means comprise plate-springs tensioned to said predetermined load and secured on the extension by locking means, the other part of the intermediate lever that is hinged to said other slide being hollow with an open end which receives said extension, said open end normally engaging said one part and having an abutment for said resilient means, said slides comprising sleeves each having a recess opening towards the rod, each recess having a surface remote from the rod and inclined to the rod, and a roller in each recess adapted to be clamped between said surface and the rod to lock the sleeve on the rod, a tappet extending from each recess and the tensioning lever can be moved to force the tappet in said one slide against the roller thereof to unclamp it and unlock the one slide from the rod and cause the one slide to press the tappet in said other slide against its roller to unclamp it and unlock the other slide from the rod, a buffer in each recess for the unclamped roller, said slides being sleeves that are overlapped by another sleeve to keep dirt from between them, said rod being a smooth rod.

* * * * *